US007413397B2

(12) United States Patent
Muramoto et al.

(10) Patent No.: US 7,413,397 B2
(45) Date of Patent: Aug. 19, 2008

(54) WORK VEHICLE HAVING FRONT LOADER

(75) Inventors: Naoya Muramoto, Sakai (JP); Arinobu Ishida, Sakai (JP); Masataka Takagi, Sakai (JP); Masayuki Nakano, Sakai (JP); Koichi Kawaguchi, Sakai (JP)

(73) Assignee: Kubota Corporation, Osaka (JP)

( * ) Notice: Subject to any disclaimer, the term of this patent is extended or adjusted under 35 U.S.C. 154(b) by 0 days.

(21) Appl. No.: 11/076,408

(22) Filed: Mar. 9, 2005

(65) Prior Publication Data

US 2006/0045716 A1 Mar. 2, 2006

(30) Foreign Application Priority Data

Jul. 16, 2004 (JP) ..... 2004-210646
Jul. 16, 2004 (JP) ..... 2004-210650

(51) Int. Cl.
*B66C 23/00* (2006.01)

(52) U.S. Cl. ..... 414/686; 296/96.12; 180/68.4

(58) Field of Classification Search ..... 414/723, 414/686; 37/468, 413, 906; 293/115; 180/68.6; 296/96.12; 165/41
See application file for complete search history.

(56) References Cited

U.S. PATENT DOCUMENTS 2,517,582 A 8/1950 Lull
3,017,046 A * 1/1962 Runci et al. ..... 414/698
4,545,720 A 10/1985 Cochran et al.
5,219,016 A * 6/1993 Bolton et al. ..... 165/41
6,071,066 A * 6/2000 Braud ..... 414/686
D463,454 S * 9/2002 Miller et al. ..... D15/22
6,634,418 B2 * 10/2003 Wooldridge ..... 165/44
2003/0010563 A1 * 1/2003 Osuga et al. ..... 180/311
2003/0075370 A1 4/2003 Haun et al .
2003/0075375 A1 4/2003 Sprinkle
2003/0223851 A1 12/2003 Muramoto
2004/0145172 A1 7/2004 Aoki et al.
2004/0265109 A1 * 12/2004 Uchijima et al. ..... 414/686

FOREIGN PATENT DOCUMENTS

JP 10-114959 5/1998
JP 2003-118410 4/2003
JP 2003-276653 10/2003

* cited by examiner

*Primary Examiner*—Donald Underwood
(74) *Attorney, Agent, or Firm*—The Webb Law Firm

(57) ABSTRACT

A work vehicle with a front loader is disclosed. The work vehicle includes a traveling control section having an operator's seat, a hood provided forwardly of the traveling control section, a pair of masts provided on right and left sides of the hood, a pair of booms projecting forwardly from upper ends of the masts and an implement detachably connected to the booms. An upper face of the hood is inclined downwardly from its rear upper portion to its front upper portion. The inclined upper face is located adjacent a downward line of sight from an operator's space in the traveling control section to a connecting portion between each boom and the implement.

19 Claims, 7 Drawing Sheets

WORK VEHICLE HAVING FRONT LOADER

BACKGROUND OF THE INVENTION

FIELD OF THE INVENTION

The present invention relates to a work vehicle having a front loader, such as a tractor or a TLB (a tractor with a front loader and a backhoe).

DESCRIPTION OF THE RELATED ART

An example of the conventional work vehicle of the above type, there are tractors known from e.g. JP-A-2003-276653 and JP-A-10-114959. In these tractors, masts are disposed erect on right and left sides of an engine hood and a pair of booms each projecting forwardly from upper ends of the masts. And, an implement mounting unit is pivotally supported to the leading end of each boom. Then, these implement mounting units engage an implement such as a bucket from behind, so that the implement is mounted to the leading ends of the booms.

In the case of the tractor disclosed by JP-A-2003-276653, various vehicle components such as a radiator are disposed at a front inner portion of the tractor. Hence, the hood covering these components is disposed at a high position even at a front upper portion of the hood and the top surface of the hood is formed substantially horizontal.

However, since the top surface of the hood is substantially horizontal, the front upper surface portion of the hood prevents an operator's view when seated at an operator's seat on the tractor from viewing a forward lower position, so that the operator an see only a position far from the tractor. Hence, when the implement mounting units are located at positions forwardly and downwardly of the hood, it is difficult for the operator to see them. As a result, the operator needs to effect the engaging operation of the implement mounting units to the bucket placed on the ground surface from the rear face of the bucket in a "groping" manner.

Further, in the case of the tractor disclosed by JP-A-10-114959 also, various vehicle components such as a radiator are disposed at a front inner portion of the tractor. Hence, the hood covering these components is disposed at a high position even at a front upper portion of the hood, and the top surface of the hood is formed substantially horizontal. Also, in each boom of this tractor, an upper edge thereof from a base on the side of the mast and an intermediate portion when the implement placed on the ground surface is mounted by the implement mounting units to an intermediate portion is inclined downwardly.

However, in the case of this tractor too, when the operator seated at the operator's seat sees the right and left sides of the implement mounting units when the implement placed on the ground surface is to be mounted by these implement mounting units, the portion of the boom from the base to the intermediate portion hinders the operator's view. Viewing the right/left center portion of the implement mounting units is also difficult as being hindered by the hood.

In view of the above-described state of the art, a primary object of the present invention is to provide a work vehicle capable of solving the above-described drawbacks of the prior art.

SUMMARY OF THE INVENTION

For accomplishing the above-noted object, according to the present invention, there is proposed a work vehicle comprising:

a traveling control section having an operator's seat;

a hood provided forwardly of the traveling control section;

a pair of masts provided on right and left sides of the hood;

a pair of booms projecting forwardly from upper ends of the masts; and an implement detachably connected to the booms;

wherein an upper face of the hood is inclined downwardly from its rear upper portion to its front upper portion and said inclined upper face is located adjacent a downward line of sight from an operator's space in the traveling control section to a connecting portion between each boom and the implement.

For accomplishing the above-noted object, according to the present invention, there is further proposed a work vehicle comprising:

a traveling control section having an operator's seat;

a hood provided forwardly of the traveling control section;

a pair of masts provided on right and left sides of the hood;

a pair of booms projecting forwardly from upper ends of the masts; and an implement detachably connected to the booms;

wherein an upper face of the hood is inclined downwardly from its rear upper portion to its front upper portion and a rearward extension of a virtual line connecting the front upper portion to a connecting portion between each boom and the implement extends past adjacent the inclined hood upper face to reach an operator's space in the traveling control section.

For accomplishing the above object, according to the present invention, there is further proposed a work vehicle comprising:

a traveling control section having an operator's seat;

a hood provided forwardly of the traveling control section;

a pair of masts provided on right and left sides of the hood;

a pair of booms projecting forwardly from upper ends of the masts; and an implement detachably connected to the booms;

wherein an upper edge of each boom is inclined downwardly from a base of the boom on the side of the mast to an intermediate portion of the boom; and a connecting portion between each boom and the implement is disposed adjacent an extension line of a downward line of sight from an operator's space of the traveling control section to the upper edge.

In the present invention, the "downward line of sight" refers to an operator's line of sight or a virtual line when the operator tries to engage the implement mounting units to the implement at the connecting portion between the implement and the booms.

In the case of the two former characterizing constructions, the operator can mount the implement placed on the ground surface while seeing the connecting portion between the booms and the implement, so that the mounting operation of the implement can be carried out simply and easily. That is, as the upper face of the hood is configured to be adjacent the line of sight of the operator at the operator's seat who is viewing the upper ends of the implement mounting units, the operator can readily mount the implement placed on the ground surface while seeing the connecting portion between the booms and the implement, without being interfered in his/her view by the front upper portion of the hood.

With the third characterizing feature described above, in mounting the implement placed on the ground surface to the implement mounting units, when the operator seated at the operator's seat sees the downwardly inclined upper ends of the booms from the base portions on the side of the masts to the intermediate portions, the operator can see the connecting portion between the booms and the implement substantially on the extension line of his/her downward line of sight. Hence, the operator can mount the implement without being visually interfered by the booms. Accordingly, the mounting operation of the implement is further facilitated.

In any of the above-described characterizing constructions, preferably, the connecting portion between the booms and the implement is approximate upper ends of the implement mounting units provided to the respective booms.

According to one preferred embodiment of the present invention, an engine is disposed inside the hood, a front axle frame projects forwardly of the engine, and a front lower portion of the hood is vertically overlapped with the front axle frame. With this construction, it is possible to lower the front upper portion of the hood by the amount of its overlap with the front axle frame. Therefore, the front upper face of the hood can be formed with an even lower profile to be located adjacent the operator's downward line of sight viewing the upper ends of the implement mounting units.

According to one preferred embodiment of the present invention, a front guard is provided forwardly of the hood, and a front upper edge of the front guard is located adjacent the downward line of sight. This construction is advantageous in that the front upper edge of the front guard does not interfere with the line of the sight of the operator who is trying to mount the implement placed on the ground surface by the implement mounting units.

According to one preferred embodiment of the present invention, the downwardly inclined upper face of the hood is substantially aligned with downwardly inclined upper edges of the booms. With this construction, when the operator seated at the operator's seat mounts the implement placed on the ground surface by the implement mounting units, neither the booms nor the upper face of the hood interfere with the operator's view. Hence, the operator can carry out the mounting operation of the implement while seeing the upper ends of the implement mounting units.

According to one preferred embodiment of the present invention, at the base of each boom, there is provided a pivot shaft for connecting the boom to the upper end of the mast corresponding thereto, and the pivot shaft is offset to an upper side from a vertical centerline of the boom. With this construction, it is possible to maintain the strength at the base of the boom on the side of the mast and also to further lower the downwardly inclined upper edge of the boom from its base to the intermediate portion. As a result, the operator can see the implement mounting units even more easily.

According to one preferred embodiment of the present invention, the implement is a bucket which is capable of a dumping/scooping operation via an implement cylinder provided in each boom and a link mechanism connected by a connecting pin to the implement cylinder;

the boom includes an implement-angle indicator rod having one end thereof connected to the connecting pin and a guide member for guiding the indicator rod; and the indicator rod forms, at an intermediate portion thereof, a mark portion for detecting a position of the indicator rod relative to this mark portion.

With this construction, the operator can recognize the presently assumed angle of the implement by viewing the position of the indicator rod at its position at the mark portion. Therefore, the front loader operation can be facilitated.

Further and other features and advantages of the invention will become apparent upon reading the following detailed description of the preferred embodiments thereof with reference to the accompanying drawings.

Incidentally, in the following description, languages relating to directions, "front/rear direction", front face", "rear face", "right/left direction" and "vertical direction" will all be used relative to the forward traveling direction of the vehicle body.

DETAILED DESCRIPTION OF THE PREFERRED EMBODIMENTS

One preferred embodiment of the present invention will be described in details with reference to the accompanying drawings.

Figure 1:
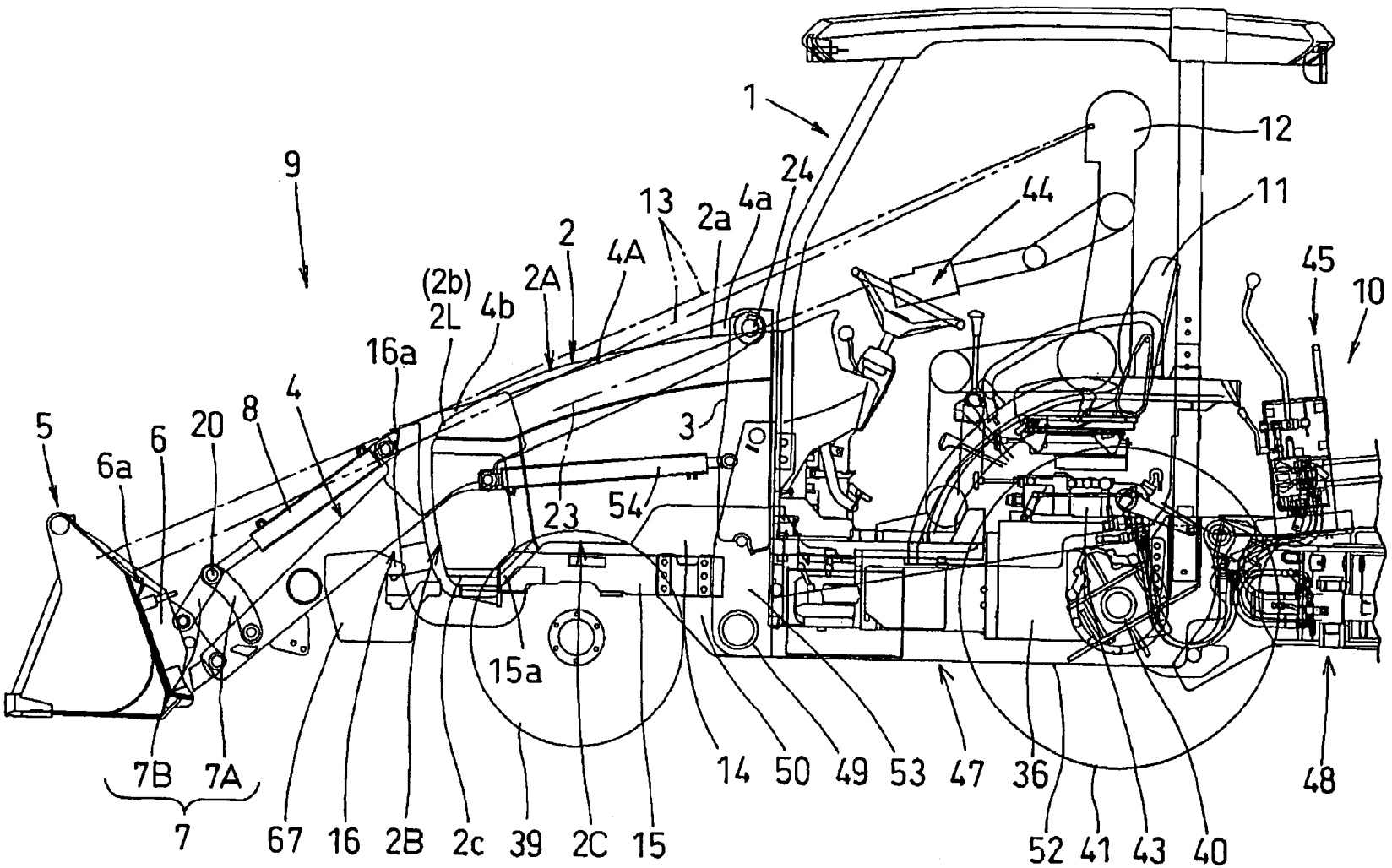
FIG. 1 shows one preferred embodiment of a work vehicle having a front loader relating to the present invention and is an overall side view of a TLB (a tractor with a front loader and a backhoe) as an example of such work vehicle.

FIG. 1 shows a TLB (a tractor with a front loader and a backhoe) including a tractor 1, a front loader 9 attached to a front portion of the tractor 1 and a backhoe 10 attached to a rear portion of the same.

In FIGS. 1-6, in this tractor 1, to an engine 14, a clutch housing 35 and a transmission case 36 are connected, thereby to form a traveling vehicle body. A front axle frame 15 projects forwardly of the engine 14 and front wheels 39 are supported thereto via front axle cases 37, front wheel final reduction units 38, etc. Rear rears 41 are supported via rear axle cases 40 projecting to the right and left sides from the transmission case 36.

At a rear upper portion of the transmission case 36, there is provided an implement lift device 43 for lifting a rear implement up/down via a three-point link means 42 (shown in FIG. 4) when the backhoe 10 is not attached. Upwardly thereof, there is provided a driver's seat 11 where an operator 12 is to be seated, with the driver's seat 11 being pivotable to the front side or the rear side. Forwardly of the driver's seat 11 when assuming the forward orientation, there is provided a traveling control section 44 for the tractor 1, and rearwardly of the seat 11, there is provided an implement control section 45 for the backhoe 10, etc.

From the engine 14 and the rear portion of the front axle frame 15 toward the rear axle cases 40 and extending from the lateral portions, the front portion to the rear portion of the traveling vehicle body, an attaching frame 47 is detachably secured. And, the backhoe 10 is attached to the rear portion of the attaching frame 47 with the three-point link means 42 is detached. FIG. 1 only shows a vehicle frame 48 and the implement control section 45 mounted thereon of the backhoe 10.

The attaching frame 47 includes a transverse member 49 formed of a pipe extending across in the right/left direction under the engine 14 and interconnecting right and left portions of the attaching frame 47. Attaching members 50 project forwardly of the transverse member 49 to be connected to the front axle frame 15. The transverse member 49 and the rear axle cases 40 are connected to each other via an auxiliary frame 52. Further, from right and left outer ends of the transverse member 49, mast supports 53 project upwardly.

The attaching frame 47 can be constructed also as a right/left separable construction. For instance, there may be provided a pair of right and left transverse members 49 formed of pipes from which the mast supports 53 project upwardly. And, to the inner ends of these transverse members 49 (i.e. their ends on the side of the traveling vehicle body), the attaching members 50 may be welded to project in the front/rear direction. Then, the front projecting portions of the attaching members 50 are bolt-fixed to the front axle frame 15 and rear projecting portions of the attaching members 50 are bolt-fixed to front/rear intermediate portions of the traveling vehicle body (side frames forming the lateral faces of the traveling vehicle body).

The front loader 9 includes the right and left mast supports 53, masts 3 detachably attached to these right and left mast supports 53, a pair of booms 4 projecting forwardly from upper ends of the respective masts 3 on the right and left sides of the hood 2 and interconnected at the front portions thereof, a pair of implement mounting units 6 pivotally attached to leading ends of the respective booms 4, and an implement 5 (a bucket in this particular embodiment) 5 to be detachably mounted from behind to the implement mounting units 6.

Between each mast 3 and each boom 4 associated therewith, there is provided a boom cylinder 54 for lifting the boom 4 up and down. Further, a link 7A provided at the leading end of the boom 4 and a further link 7B provided to the implement mounting unit 6 together constitute a link mechanism 7. Ends of these two links 7A, 7B are connected to each other via a connecting pin 20. And, an implement cylinder 8 is provided between the connecting pin 20 and an upward intermediate portion of the boom 4 for operating the implement 5 for a dumping/scooping operation.

In the rear face of the implement 5, there are formed engaging portions 5A for introducing the implement mounting units 6 and receiving portions 5B, with the portions 5A, 5B being vertically opposed to each other. Between the implement 5 and the implement mounting unit 6, there is provided an attaching means 51 for preventing inadvertent withdrawal of the implement mounting unit 6 inserted into the engaging portion5A of the implement 5. This attaching means 51 is constructed e.g. such that a pin vertically movable (or movable to the right or left) by means of a control lever projects from the implement mounting unit 6 to be engaged into a hole defined in the implement 5.

Figure 3:
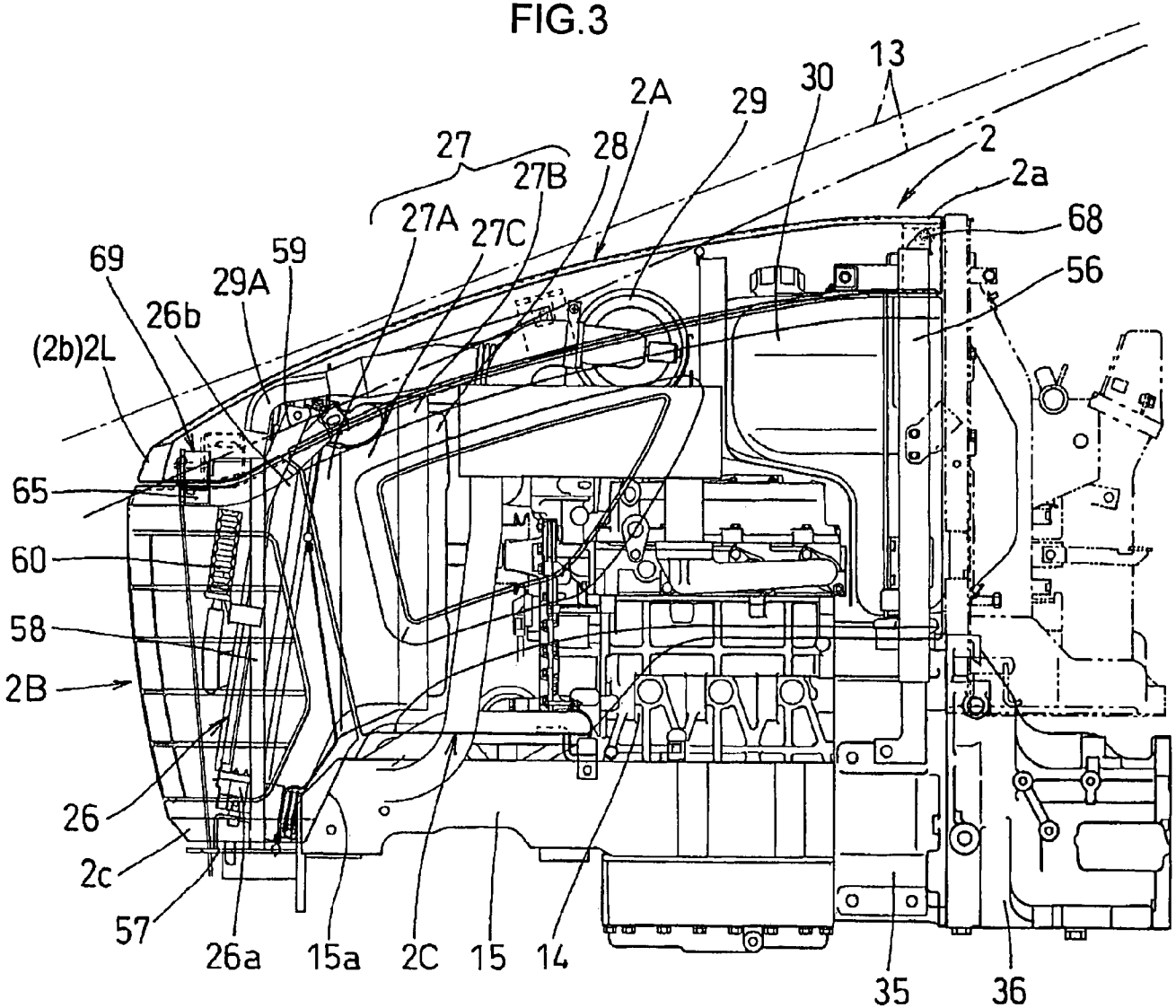
FIG. 3 is a side view of a front portion of the tractor.
Figure 4:
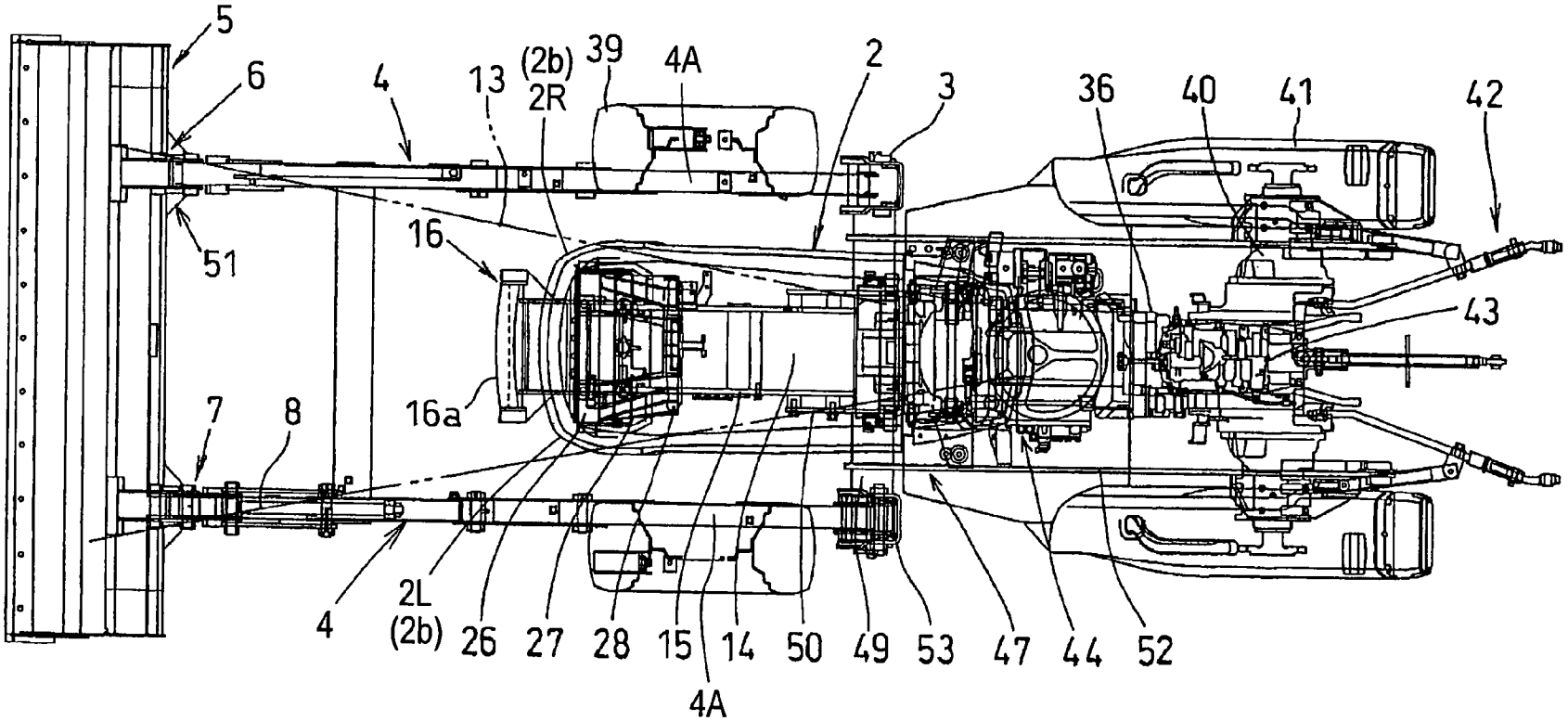
FIG. 4 is a plan view of the TLB shown in FIG. 1, showing a condition thereof with the backhoe being detached therefrom.
Figure 6:
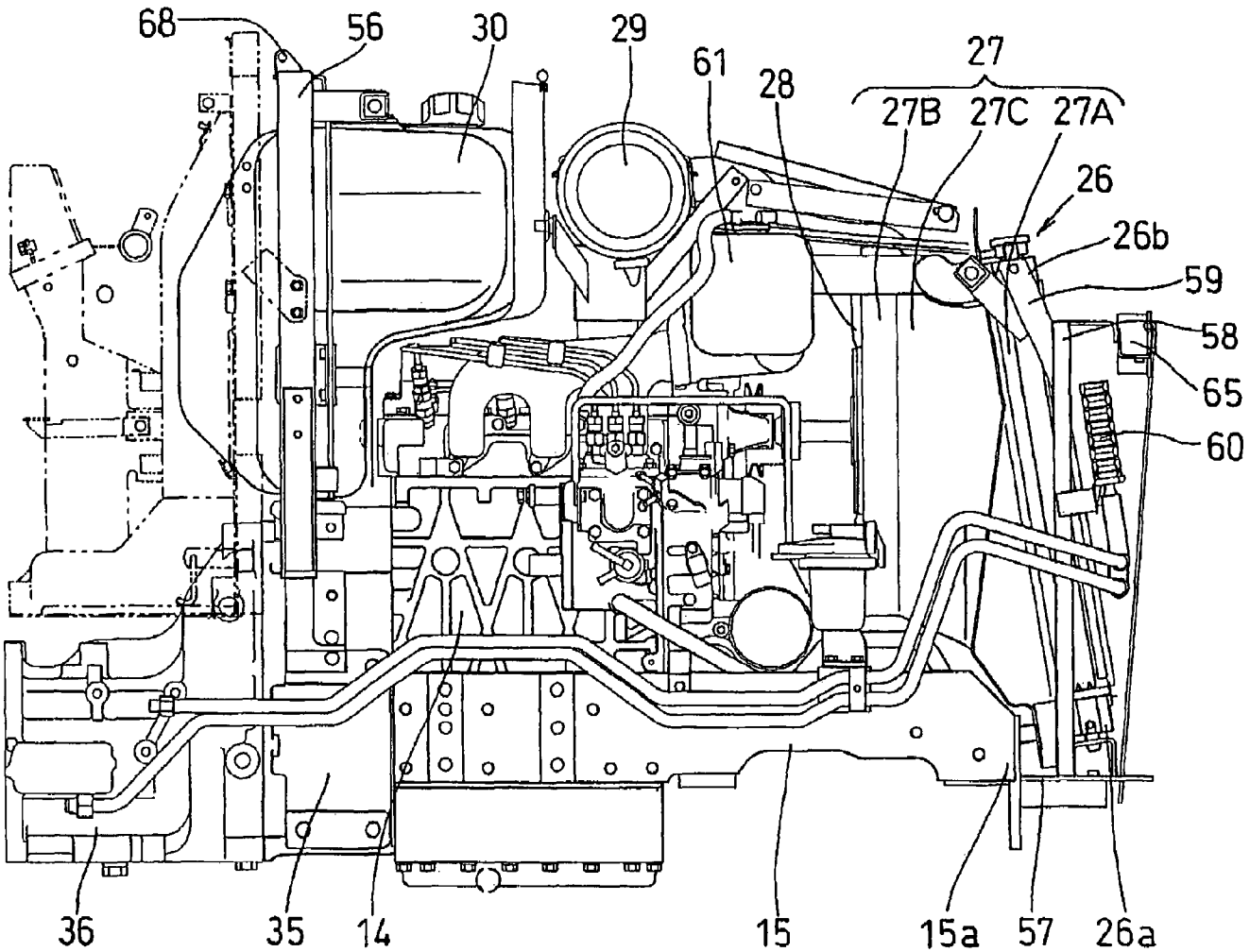
FIG. 6 is a side view showing an inner construction of the front portion of the tractor.

In FIG. 3 and FIG. 6, to the leading end of the front axle frame 15, there is affixed an attaching table 57 in substantial alignment with the lower edge of the front axle frame 15, and a radiator 26 and a stay 58 are mounted on this attaching table 57.

Therefore, a lower portion 26*a* of the radiator 26 is vertically overlapped with a front end 15*a* of the front axle frame 15. Hence, the radiator is disposed lower by a distance substantially corresponding to the vertical width of the front axle frame 15 than a case where the radiator 26 were disposed at an upper portion of the front axle frame 15.

The stay 58 is disposed substantially perpendicularly on the attaching table 57. Whereas, an upper portion 26*b* of the radiator 26 is disposed with a rearward inclination to be located rearwardly of the lower portion 26*a* of the radiator 26, so that the upper end of the stay 58 is disposed lower than a case where the stay were disposed perpendicularly.

The upper end of the stay 58 is disposed forwardly and downwardly of the front end of the radiator 26 and a bracket 59 projecting upwardly and rearwardly of the stay 58 is connected to right and left upper portions of the radiator 26 to support the radiator 26. Further, to the front of the stay 58, an oil cooler 60 is attached.

Numeral 27 denotes a fan shroud for guiding air flow from a fan 28. This fan shroud 27 includes a radiator connecting portion 27A connected to the radiator 26, a surrounding portion 27B surrounding the fan 28, and an inclined connecting portion 27C interconnecting the radiator connecting portion 27A and the surrounding portion 27B. Since the radiator 26 is disposed at a height vertically overlapped with the front end 15*a* of the front axle frame 15, the center of the radiator 26 is significantly offset vertically relative to the axis of the fan 28. For this reason, the inclined connecting portion 27C is needed which is inclined to allow the fan shroud 27 too to cope with the vertical offset arrangement.

Upwardly and forwardly of the engine 14 rearwardly of the radiator 26, there is disposed an air cleaner 29. Rearwardly and upwardly of the engine 14, there is disposed a fuel tank 30 supported on a support frame 56 mounted erect on the clutch housing 35. And, upper ends of all these components are disposed higher than the upper end of the upper portion 26*b* of the radiator 26.

An air intake hose 29A of the radiator 29 extends forwardly above the radiator 26 and a reserve tank 61 is disposed forwardly and downwardly of the air cleaner 29. These components, i.e. the air intake hose 29A and the reserve tank 61, are also disposed lower than the upper end of the air cleaner 29, whereby the heights of the vehicle components mounted at the front upper portion of the tractor 1 are progressively reduced toward the front side.

The engine 14, the radiator 26, the air cleaner 29, etc. are covered by a hood 2 having a top portion 2A, a front grill portion 2B and right and left side portions 2C.

In the hood 2, the top portion 2A is formed separately from the front grill portion 2B and the right and left side portions 2C. A rear upper portion of the top portion 2A is pivoted via a transverse shaft 68 to the support frame 56 and a front portion of the top portion 2A is received by a receiving member 65 provided at an upper portion of the stay 58.

The front grill portion 2B is disposed forwardly and downwardly of the top portion 2A in such a manner that the front grill portion 2B and the top portion 2A together form an L-shape as seen in a side view and the front grill portion 2B is attached to the stay 58, the attaching table 57, etc. Upper portions of the right and left side portions 2C correspond to an intermediate portion to a rear upper portion of the top portion 2A. Front edges of the side portions 2C are connected to the front grill portion 2B and rear portions thereof are attached to the support frame 56, etc. The front grill portion 2B and the right and left side portions 2C have porous portions for allowing air passage therethrough.

Referring more particularly to the hood 2, the front portion of the openable/closable top portion 2A is placed on the stay 58 and the hood 2 can be maintained under a closed state by means of a closure locking means 69. This closure locking means 69 is releasable from under (or from the front face) of the front grill portion 2B. Upon releasing, the top portion 2A can be opened.

The front grill portion 2B is disposed such that a lower portion thereof (the front lower portion 2*c* of the hood 2) is vertically overlapped with the front axle frame 15. The upper portion of the front grill portion 2B (the front upper portion 2*b* of the hood 2) is disposed downwardly of the upper ends of the radiator 26 and the stay 58 and the front upper portion of the hood 2 is lowered by the amount of its overlap with the front axle frame 15. Therefore, the leading end of the upper face of the top portion 2A of the hood 2 is disposed lower than the upper end of the radiator 26.

More particularly, the upper face of the hood 2 is shaped like an upwardly projecting arc, with a portion thereof from its rear upper portion 2*a* to an intermediate portion being inclined gently downward and a further portion thereof from the intermediate portion to the front upper portion 2*b* being inclined sharply downward. The upper face of the hood with such downward inclinations, especially, its front upper portion 2*b* is configured to be disposed adjacent a downward sight line 13 along which the operator 12 seated at the operator's seat 11 views the upper ends 6*a* of the implement mounting units 6 when trying to mount the implement 5 placed on the ground surface by the implement mounting units 6. In this invention, this downward sight line 13 is a line of sight or a virtual line of the operator when the operator tries to engage the implement mounting units 6 to the implement 5 at the connecting portions between the implement 5 and the booms 4. With this construction, the operator 12 can mount the implement 5 placed on the ground surface while viewing the approximate upper ends 6*a* of the implement mounting units 6. Hence, the mounting operation of the implement 5 can be carried out simply and easily.

Especially, the lower edge of the front lower portion 2*c* of the hood 2 is located at a substantially same height as the lower edge of the front axle frame 15 to be vertically overlapped with the front axle frame 15, so that the hood 2 is located at a position lowered by the amount of this overlap. As a result, the front upper face of the hood 2 can have a reduced height.

Forwardly of the hood 2, there is provided a front guard (front protector) 16. This front guard 16 includes a guard portion 16A disposed forwardly of the hood 2 and an arm portion 16B for attaching a lower portion of the guard portion 16A to the front portion of the front axle frame 15.

In this front guard 16, one or two plates are joined to form a pair of right and left side members 62 having a substantially L-shape and extending from the guard portion 16B to the guard portion 16A, and between vertical portions of these right and left side members 62, there are affixed a plurality of (two) pipe members 63 and one upper plate member 64 to form the guard portion 16A.

The right and let side members 62 are formed like an angular hook with an intermediate portion of the arm portion 16B being formed lower than front and rear portions of the same and rear portions of the side members 62 are bolt-fixed to the front axle frame 15. More particularly, the arm portion 16B first projects downward from the front portion of the front axle frame 15 and then projects forwardly from its end to pass the underside of the front grill portion 2B and rises up forwardly of the front lower portion 2*c* of the hood 2 to be connected to the guard portion 16A. As the front grill portion 2B is overlapped with the front axle frame 15, the side members 62 extend around (bypassing) this and extend forwardly from the rear of the front grill portion 2B and past under this portion 2B.

A front edge of the upper plate member 64 forming the front upper portion of the front guard 16 is formed like a forwardly projecting arc. Hence, a right/left center of this front edge of the upper plate member 64 projects most prominently of front face portions of the front guard 16 such as the right and left side members 62 and the pipe member 63, so that this portion forms a "distance (far/near) eye-estimation portion" or a "first bumping portion" when the operator drives the tractor 1 toward a side face of a truck. A weight 67 is detachably attached to the front guard 16.

Figure 2:
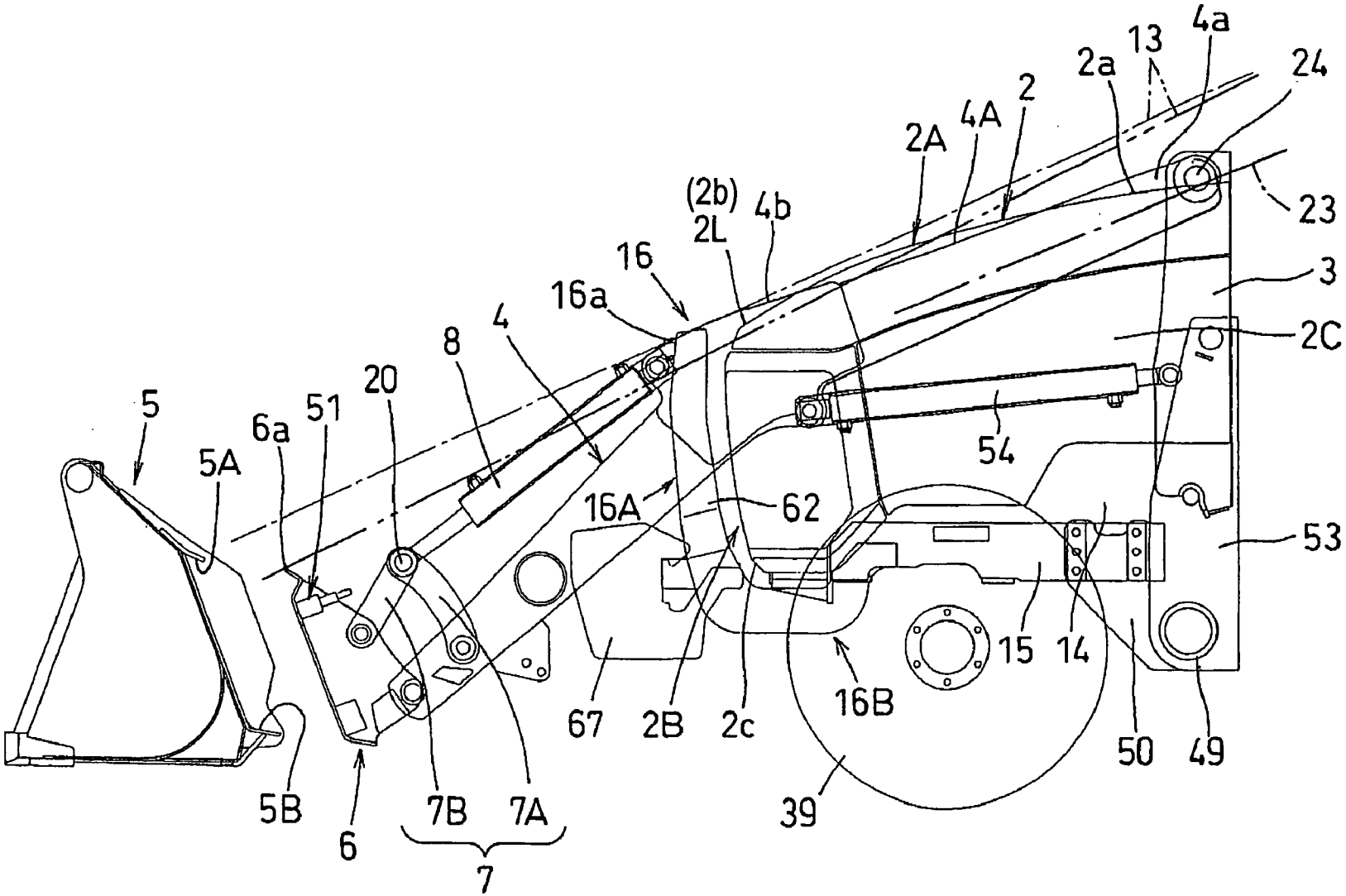
FIG. 2 is a side view of the front loader with an implement detached therefrom.

In this front guard 16, as shown in FIG. 2, a front edge center of the upper plate member 64 is located on an extension of the downward sight line 13 of the operator 12 who views the leading end of the upper face of the top portion 2A of the hood 2. Hence, when the operator 12 views the front edge center of the upper plate member 64, this view is not hindered by the top portion 2A.

Figure 5:
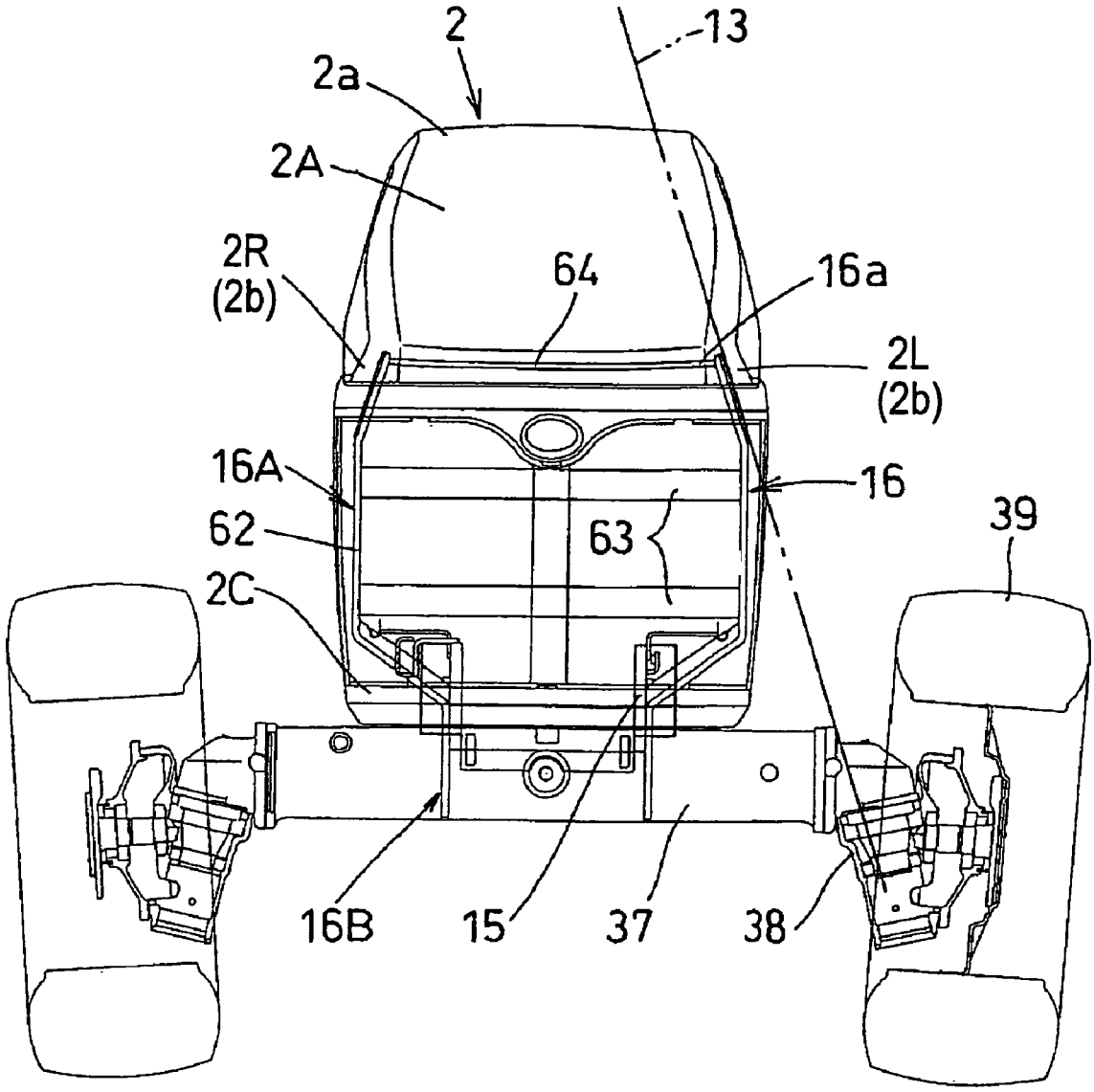
FIG. 5 is a front view of the tractor.

Further, as shown in FIG. 5, referring to the guard portion 16A of the front guard 16, the right and left side members 62 are inclined to be closer to each other from their intermediate portions to the upper ends. Hence, the right and left upper ends of the guard portion 16A do not interfere with the downward sight line 13 of the operator who views the upper face leading ends of the right and left side portions of the top portion 2A of the hood 2.

Incidentally, the top portion 2A of the hood 2 is formed higher at a mid portion thereof not only in the front/rear direction, but also in the right/left direction, with right and left side edges of the top portion 2A being chamfered in the form of arcs. Therefore, the downward sight line 13 extends more downwardly on the right and left sides of the top portion 2A than the center portion of the same.

As described above, the downward sight line 13 is mainly a line of sight or a virtual line of the operator who tries to engage the implement mounting units 6 to the implement 5. Namely, the operator 12 will first place the implement 5 on the ground surface and then insert the implement mounting units 6 to the engaging portions 5A from their rear and lower sides. In the course of this, the operator will move the tractor 1 and operate the implement cylinders 8 and the boom cylinders 54 while feeling (estimating) fore-and-aft and vertical distances between the implement mounting units 6 and the engaging portions 5A by viewing the upper ends 6*a* of the implement mounting units 6. Further, the upper face of the top portion 2*a* and the front grill portion 2B are shaped in such a way as to allow the operator to view the upper ends 6*a* of the implement mounting units 6.

The operator's line of sight when viewing the right/left center of the upper ends 6*a* of the implement mounting units 6 is the downward sight line 13 shown by a dashed line in FIGS. 1 and 2, and the operator's line of sight when viewing the right and left opposed ends of the upper ends 6*a* is the further downward sight line 13 shown by a two-dot line in FIGS. 1 and 2. Although it is best if the operator can see the upper ends 6*a* of the implement mounting units 6 along both of these sight lines 13 shown by the dashed line and the two-dot line, it may suffice if the operator can see at least along the sight line 13 shown by the two-dot line. It should be noted, however, that the height of the eyes of the operator 12 will vary depending on the physical height of each particular operator and also the eye height can be changed appropriately if the operator 12 rise up off the seat 11.

In this embodiment, the lateral width of the implement 5 is rendered greater than the lateral width of the hood 2 and the distance between the opposed implement mounting units 6 is also rendered greater than the lateral width of the hood 2. Hence, as shown in the plan view of FIG. 4, the downward sight line 13 shown by the two-dot line which widens to the right and left sides extends through the vicinities of right and left corner portions 2L, 2R of the upper face of the hood 2 to reach the approximate upper ends 6*a* of the implement mounting units 6.

The right and left opposed ends of the upper ends 6*a* of the implement mounting units 6 are located on the outer sides in the right/left direction from the right and left booms 4. Hence, the downward sight line 13 extends above the booms 4. For this reason, each boom 4 is shaped such that an upper edge configuration 4A thereof from a base 4*a* on the side of the mast 3 to an intermediate portion 4*b* during the mounting of the implement 5 placed on the ground surface by the implement mounting units 6 is disposed adjacent the downward sight line 13.

Each boom 4 is hooked, but with an angle of flexion (hook) which is greater than the conventional configuration so that the boom 4 is formed more straight than the conventional boom. With this, the upper edge configuration 4A from the base 4*a* to the intermediate portion 6*b* is inclined downward to be substantially aligned with the downward sight line 13.

Further, at the base 4*a* of the boom 4 on the side of the mast 3, there is provided a base shaft (corresponding to boom pivot shaft) 24 which is upwardly offset from a vertical width centerline 23 of the boom 4 for pivoting this boom 4 to the upper end of the mast 3 associated therewith. With this, the strength of the base 4*a* of the boom 4 on the side of the mast 3 is ensured and at the same time the portion of the boom upwardly of the centerline 23 is formed smaller thereby to further reduce the altitude of the downward sight line 13.

Figure 7:
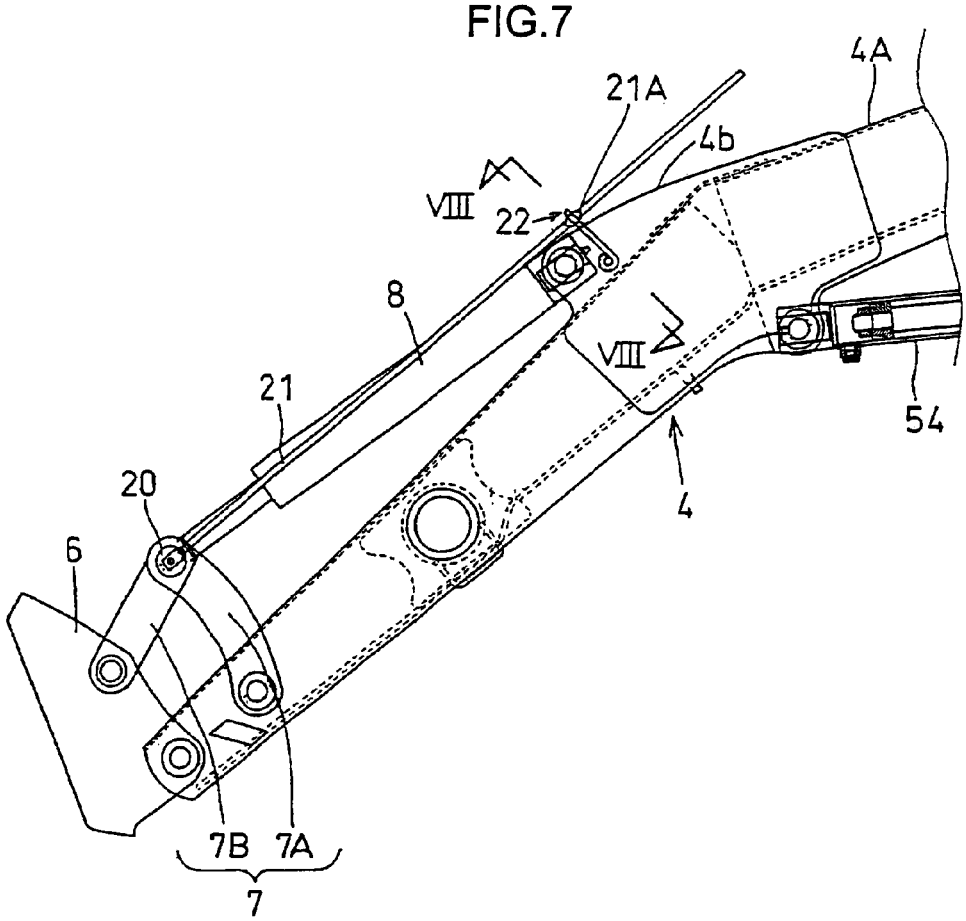
FIG. 7 is a side view of an implement-angle indicating means.
Figure 8:
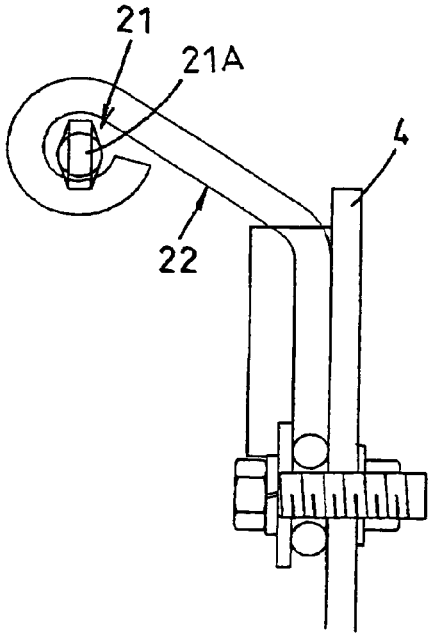
FIG. 8 is a section taken along a line VIII-VIII in FIG. 7.

As shown in FIG. 7 and FIG. 8, to the connecting pin 20 connecting the link 7A on the side of the boom 4, the link 7B on the side of the implement mounting unit 6 and the implement cylinder 8, a leading end of an implement-angle indicator rod 21 is connected. And, a guide member 22 for guiding an intermediate portion of the indicator rod 21 is provided at an intermediate portion of the boom 4. Further, at an intermediate portion of the indicator rod 21, there is formed a mark portion 21A for detecting a position relative to the guide member 22.

The indicator rod 21 and the guide member 22 are disposed at front-rear intermediate portions of the boom 4 on its face on the side of the hood 2. Hence, it is possible for the operator to estimate along the downward sight line 13 whether the mark portion 21A is located at a same position as the guide member 22 or how far the former is located from the latter.

Specifically, when the mark portion 21A is located at the same position as the guide member 22, this means that the bottom face of the implement 5 is now substantially horizontal. If the mark portion 21A is located forwardly of the guide member 22, this means that the implement 5 is now engaged in a dumping operation. Conversely, if the mark portion 21A is located rearwardly of the guide member 22, this means that the implement 5 is now engaged in a scooping operation.

The mark portion 21A may comprise a painted mark. It is preferred, however, that the intermediate portion of the indicator rod 21 be formed thinner and wider than the other portions thereof so as to restrict peeling off of the paint.

The shapes and the positional relationships in the front/rear direction, right/left direction and vertical directions of the respective components employed in the foregoing embodiment are best when constructed as shown in FIGS. 1-8. However, the present invention is not limited thereto, but various modification in the shapes and constructions of these components as well as combinations thereof would be possible within the skill of one skilled in the art.

For instance, the present invention may be applied to a front loader type tractor having no backhoe 10 attached to the rear thereof. Further, each mast 3 can be formed integral with each mast support 53 to render the front loader 9 non-detachable from the attaching frame 47.

Also, the top portion 2A, the front grill portion 2B and the right and left side portions 2C of the hood can be formed integral with each other, so that the entire hood 2 may be opened/closed with the front guard 16 attached thereto or detached therefrom.

The attaching frame 47 may be formed of the transverse member 49 and members projecting forwardly and rearwardly therefrom so as to connect the rear portion of the engine 14 to the front portion of the transmission case 36.

The invention claimed is:

1. A work vehicle comprising:

a traveling control section having an operator's seat;

a hood provided forwardly of the traveling control section;

a radiator provided at a forward end region inside the hood;

an engine disposed inside the hood and rearwardly of the radiator;

a pair of masts provided on right and left sides of the hood;

a pair of booms projecting forwardly from upper ends of the masts; and an implement detachably connected to the booms;

the radiator inclined rearward with its upper portion located rearwardly of its lower portion;

a front axle frame projects forwardly of the engine, a lower portion of the radiator is connected to an attaching table affixed to a front end of the front axle frame and the lower portion of the radiator is vertically overlapped with the front end of the front axle frame so that an upper face of the hood is inclined downwardly from its rear upper portion to its front upper portion; and said inclined upper face is located adjacent a downward line of sight from an operator's space in the traveling control section to a connecting portion between each boom and the implement.

2. The work vehicle according to claim 1, wherein for each boom, an implement mounting unit for the implement is provided and said connecting portion is an upper end of said implement mounting unit.

3. The work vehicle according to claim 1, wherein an engine is disposed inside the hood, a front axle frame projects forwardly of the engine, and a front lower portion of the hood is vertically overlapped with the front axle frame.

4. The work vehicle according to claim 1, wherein a front guard is provided forwardly of the hood, and a front upper edge of the front guard is located adjacent the downward line of sight.

5. A work vehicle comprising:

a traveling control section having an operator's seat;

a hood provided forwardly of the traveling control section;

a radiator provided at a forward end region inside the hood;

an engine disposed inside the hood and rearwardly of the radiator;

a pair of masts provided on right and left sides of the hood;

a pair of booms projecting forwardly from upper ends of the masts; and an implement detachably connected to the booms;

the radiator inclined rearward with its upper portion located rearwardly of its lower portion;

a front axle frame projects forwardly of the engine, a lower portion of the radiator is connected to an attaching table affixed to a front end of the front axle frame and the lower portion of the radiator is vertically overlapped with the front end of the front axle frame so that an upper face of the hood is inclined downwardly from its rear upper portion to its front upper portion; and a rearward extension of a virtual line connecting the front upper portion to a connecting portion between each boom and the implement extends past adjacent the inclined hood upper face to reach an operator's space in the traveling control section.

6. The work vehicle according to claim 5, wherein for each boom, an implement mounting unit for the implement is provided and said connecting portion is an upper end of said implement mounting unit.

7. The work vehicle according to claim 5, wherein the downwardly inclined upper face of the hood is substantially aligned with downwardly inclined upper edges of the booms.

8. The work vehicle according to claim 5, wherein an engine is disposed inside the hood, a front axle frame projects forwardly of the engine, and a front lower portion of the hood is vertically overlapped with the front axle frame.

9. The work vehicle according to claim 5, wherein a front guard is provided forwardly of the hood, and a front upper edge of the front guard is located adjacent the downward line of sight.

10. The work vehicle according to claim 5, wherein at the base of each boom, there is provided a pivot shaft for connecting the boom to the upper end of the mast corresponding thereto, and the pivot shaft is offset to an upper side from a vertical centerline of the boom.

11. The work vehicle according to claim 5, wherein the implement is a bucket which is capable of a dumping/scooping operation via an implement cylinder provided in each boom and a link mechanism connected by a connecting pin to the implement cylinder;

the boom includes an implement-angle indicator rod having one end thereof connected to the connecting pin and a guide member for guiding the indicator rod; and the indicator rod forms, at an intermediate portion thereof, a mark portion for detecting a position of the indicator rod relative to the guide member.

12. A work vehicle comprising:

a traveling control section having an operator's seat;

a hood provided forwardly of the traveling control section;

a radiator provided at a forward end region inside the hood;

an engine disposed inside the hood and rearwardly of the radiator;

a pair of masts provided on right and left sides of the hood;

a pair of booms projecting forwardly from upper ends of the masts; and an implement detachably connected to the booms;

the radiator inclined rearward with its upper portion located rearwardly of its lower portion;

a front axle frame projects forwardly of the engine, a lower portion of the radiator is connected to an attaching table affixed to a front end of the front axle frame and the lower portion of the radiator is vertically overlapped with the front end of the front axle frame so that an upper face of the hood is inclined downwardly from its rear upper portion to its front upper portion;

an upper edge of each boom is inclined downwardly from a base of the boom on the side of the mast to an intermediate portion of the boom; and a connecting portion between each boom and the implement is disposed adjacent an extension line of a downward line of sight from an operator's space of the traveling control section to the upper edge.

13. The work vehicle according to claim 12, wherein for each boom, an implement mounting unit for the implement is provided and said connecting portion is an upper end of said implement mounting unit.

14. The work vehicle according to claim 12, wherein the hood has a downwardly inclined upper face substantially aligned with downwardly inclined upper edges of the booms.

15. The work vehicle according to claim 12, wherein at the base of each boom, there is provided a pivot shaft for connecting the boom to the upper end of the mast corresponding thereto, and the pivot shaft is offset to an upper side from a vertical centerline of the boom.

16. The work vehicle according to claim 12, wherein the implement is a bucket which is capable of a dumping/scooping operation via an implement cylinder provided in each boom and a link mechanism connected by a connecting pin to the implement cylinder;

the boom includes an implement-angle indicator rod having one end thereof connected to the connecting pin and a guide member for guiding the indicator rod; and the indicator rod forms, at an intermediate portion thereof, a mark portion for detecting a position of the indicator rod relative to the guide member.

17. The work vehicle according to claim 1, wherein an upper surface of the attaching table of the radiator extends at a substantially same level with a lower surface of the front axle frame.

18. The work vehicle according to claim 5, wherein an upper surface of the attaching table of the radiator extends at a substantially same level with a lower surface of the front axle frame.

19. The work vehicle according to claim 12, wherein an upper surface of the attaching table of the radiator extends at a substantially same level with a lower surface of the front axle frame.

* * * * *